United States Patent [19]

Sanders

[11] 4,021,019

[45] May 3, 1977

[54] HEAVE COMPENSATING CRANES

[75] Inventor: Raymond J. Sanders, Vancouver, Canada

[73] Assignee: British Columbia Research Council, Vancouver, Canada

[22] Filed: Mar. 24, 1975

[21] Appl. No.: 561,331

[52] U.S. Cl. ..... 254/172; 212/3; 214/12

[51] Int. Cl.[2] ..... B66D 1/48

[58] Field of Search ..... 254/172, 148, 173, 175.7, 254/139.1; 214/12, 13, 14; 61/46; 37/66, 65; 114/.5 F; 212/3, 8 R

[56] References Cited

UNITED STATES PATENTS

| | | | |
|---|---|---|---|
| 2,309,715 | 2/1943 | Rudow | 214/14 |
| 2,777,112 | 1/1957 | Coker et al. | 212/8 R |
| 2,830,711 | 4/1958 | Bill | 212/8 R |
| 3,150,860 | 9/1964 | Nelson | 254/172 |
| 3,467,360 | 9/1969 | Mizell | 254/175.7 |
| 3,559,817 | 2/1971 | Brown | 212/3 |
| 3,591,022 | 7/1971 | Polyakov et al. | 214/14 |
| 3,624,783 | 11/1971 | Chang | 254/172 |
| 3,662,991 | 5/1972 | Lakiza et al. | 254/172 |
| 3,721,293 | 3/1973 | Ahlstone et al. | 254/172 |
| 3,729,100 | 4/1973 | Tanabe | 212/3 |
| 3,749,367 | 7/1973 | Joubert | 254/175.7 |
| 3,804,268 | 4/1974 | Barron | 254/172 |
| 3,871,527 | 3/1975 | Schimmeger et al. | 254/172 |
| 3,905,580 | 9/1975 | Hooper | 254/172 |

FOREIGN PATENTS OR APPLICATIONS

| | | | |
|---|---|---|---|
| 320,285 | 5/1965 | Sweden | 212/3 |

*Primary Examiner*—L. J. Paperner
*Assistant Examiner*—Kenneth Noland
*Attorney, Agent, or Firm*—Larson, Taylor & Hinds

[57] ABSTRACT

A crane for ships and having a boom pivotally mounted for vertical movement on a base, telescopic hydraulic jack means connected to the boom to support the outer end thereof in a desired position, a pulley carried by the boom near the outer end thereof and means for shifting the pulley towards and away from the base, a cable threaded over the pulley and winch means for reeling in and paying out this cable, and a control system including accumulator means connected to the jack means for maintaining the boom outer end substantially in the position thereof regardless of ship motion under wave action when the cable is supporting a load in the water.

20 Claims, 9 Drawing Figures

Figure 1:
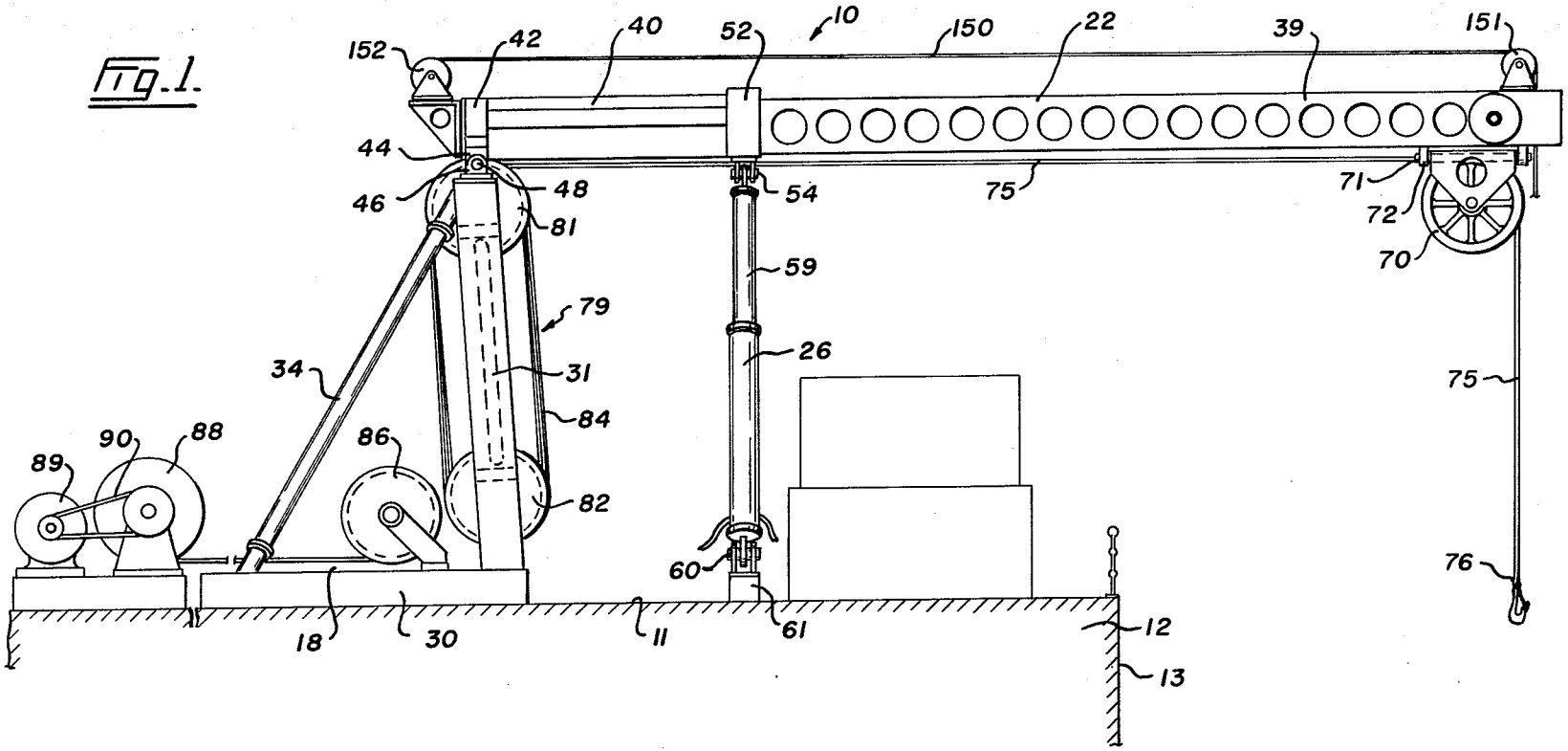

Fig. 5.
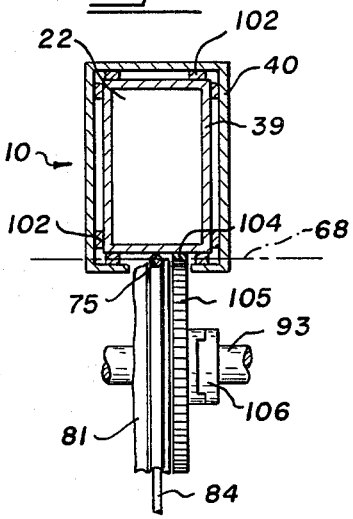
Fig. 6.
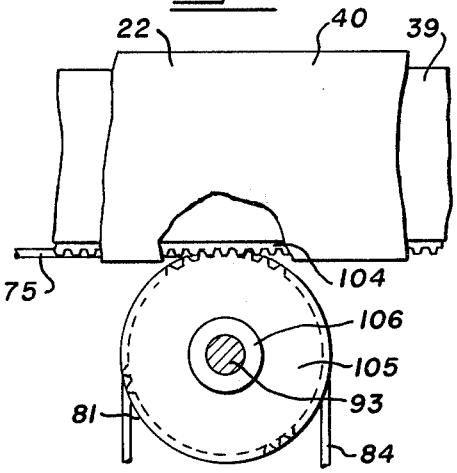
Fig. 8.
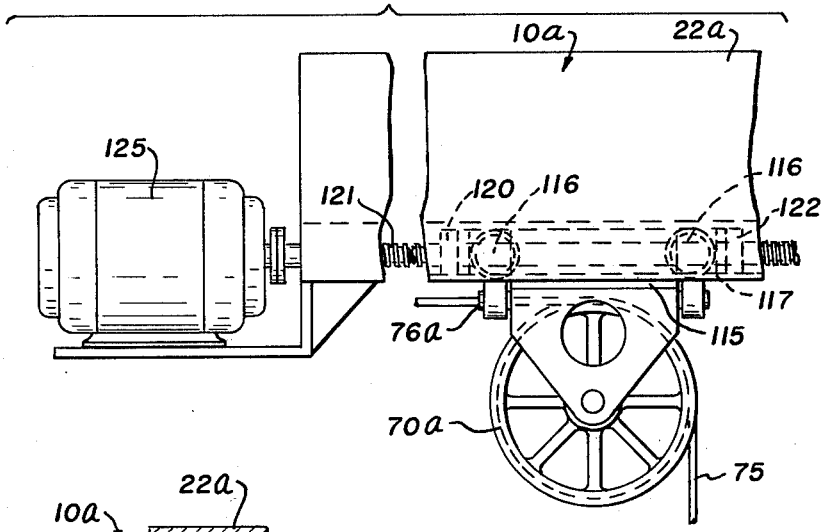
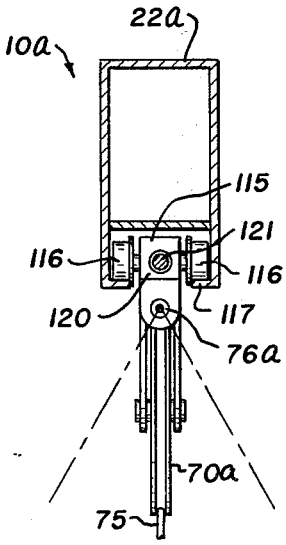
Fig. 7.

HEAVE COMPENSATING CRANES

This invention relates to cranes for ships, and particularly to cranes for supporting loads over the side of the ships at constant depths in the water relatively uneffected by motions of the ship resulting from wave action.

It is often necessary to support heavy loads in the water at relatively great depths without the loads being affected by ship motion resulting from wave action, such as in exploring the depths of the ocean by means of closed-circuit television systems and other instrumentation; or to raise relatively heavy loads from the depths without being subjected to wave action motion during this action. If the heavy loads were to rise and fall with the ship, the supporting cables and the associated mechanisms would be subjected to tremendous strains and be subject to breakage. Heave-compensating crane-like devices have been used to support loads raised and lowered over the side or stern of a ship and held at constant depths unaffected by wave action and the resulting motions of the ship.

Two types of heave compensating devices are well known in the art. These differ primarily according to the means used to transfer loads inboard and outboard. One such device uses an A-frame structure to transfer the load by pivoting over center. In so doing it incurs serious penalties with respect to motion compensation owing to an unfavourble geometry of the support cylinders of the frame which introduces excessive friction. The A-frame system is further penalized by the need to deflect the cable about a sheave near the A-frame pivot point, which conflicts with the requirements of direct and simple cable routing, minimum cable flexure and non-interference with load transfer.

The second well known system uses a single boom mounted on a rotating turret structure. Rotation of the turret serves to transfer the load, and may be complemented by an articulated boom extension. This system offers motion compensation superior to the A-frame because the support cylinders of the boom act in a favourable direction. Routing of the cable from the rotatable turret to a winch fixed to the deck is undesirable because of the need for extra sheaves and precise co-ordination of turret and winch operation.

The crane of the present invention is adapted to be mounted on a ship and includes a single boom. The heave of the boom tip is reduced or eliminated by a passive control system which includes accumulator means connected to telescopic hydraulic jack means which supports the boom. This simple system may be used alone, or where it is likely to be used under severe conditions, an active control system parallel to the passive system may be employed. This active system includes means on the boom for detecting any tendency for the boom to swing downwardly or upwardly when the ship is subjected to wave action, and pump means responsive to the detector means for directing hydraulic fluid into and removing fluid from the jack means to offset any such tendency of the outer end of the boom to move upwardly or downwardly. The load carrying cable is threaded over a pulley which is carried by the boom, and means is provided for shifting this pulley towards and away from a boom-supporting base. By using a passive system in parallel with an active system to control the boom position, much smaller power demands are made of the active system in response to control signals from the detecting means on the boom.

A heave compensating crane in accordance with this invention comprises a base be be mounted on a ship, a boom mounted adjacent an inner end thereof on a pivot carried by the base for swinging movement in a substantially vertical plane and having an outer end adapted to extend outwardly beyond the side or stern of the ship, telescopic jack means to be mounted on the ship and connected to the boom spaced from the pivot thereof to support the boom, a pulley carried by the boom and positioned outboard of the ship when the crane is in operation, a cable threaded over the pulley and having a free end to which a load can be attached, said cable extending from the pulley towards the inner end of the boom, winch means for reeling in and paying out the cable, and a passive control system including accumulator means connected to the jack means for retaining the boom through said jack means in position maintaining the load attached to and supported by the cable substantially unaffected by ship motion resulting from wave action.

It is preferable to provide means for shifting the pulley towards and away from the base in order to be able to shift loads on to and off the deck of the ship. This can be accomplished by making the boom in telescoping sections, or by mounting the pulley on a carriage which is movable along the boom. If the crane is to be used in severe conditions, it is desirable to provide an active control system parallel to the passive system and connected to the jack means. This active system comprises means on the boom near the outer end thereof for detecting movement of the boom outer end downwardly or upwardly when the ship is subjected to wave action, and regulating means responsive to said detecting means for directing pressurized hydraulic fluid into and removing fluid from the jack means to overcome any tendency of the boom outer end to move respectively downwardly or upwardly.

A further refinement is to provide the compensating crane with winch means which comprises a pair of spaced-apart driven winch drums around which the cable is wound in successive loops, one of these drums being located adjacent the pivot of the boom and the other drum being located below the first-mentioned drum. With this arrangement, the compressive loads within the winch means are partially balanced by the upwards load exerted by the boom, or inversely the loaded cable partially balances the boom on the telescopic jack means.

Figure 2:
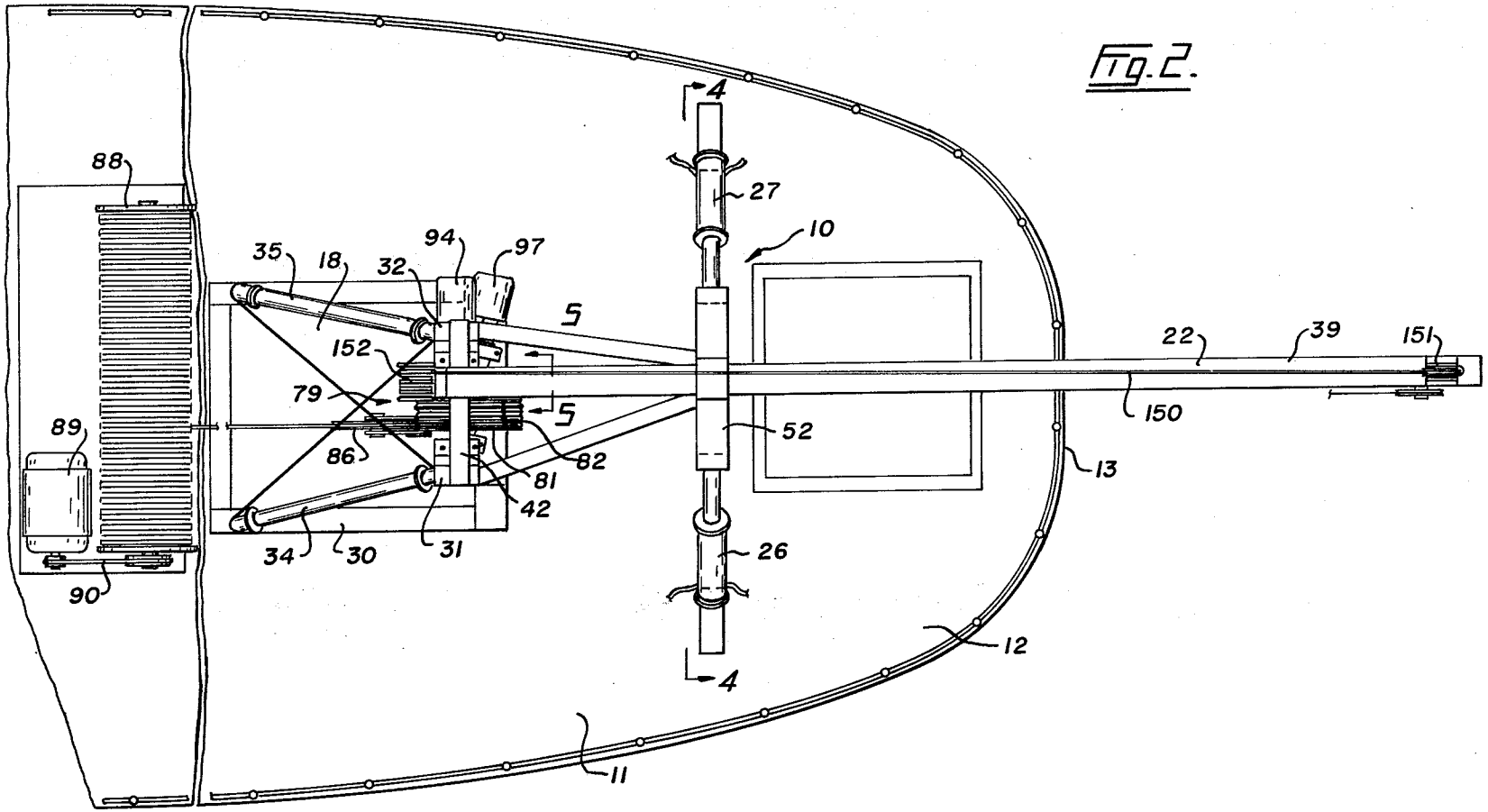
Figure 3:
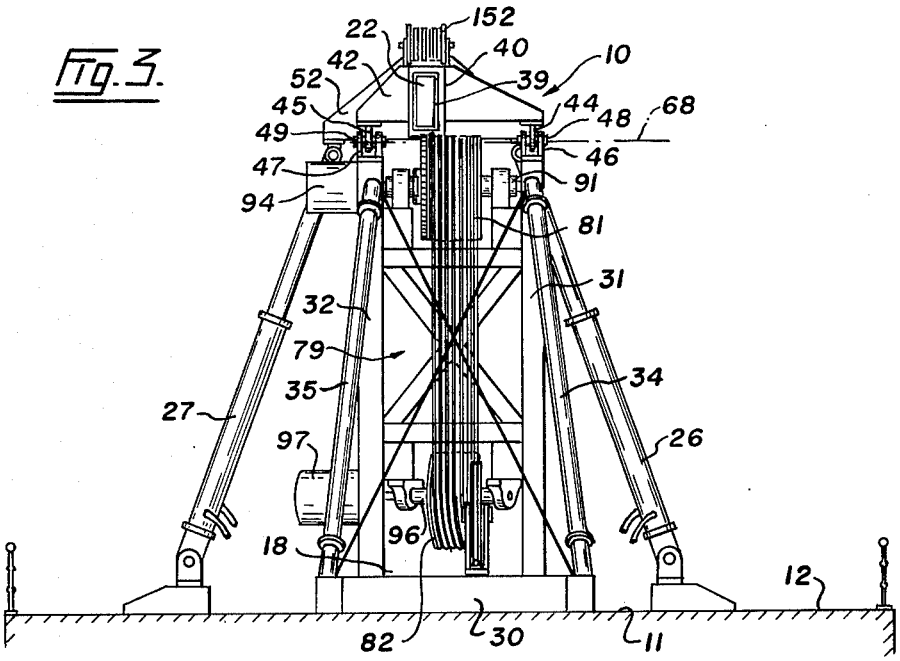
Figure 4:
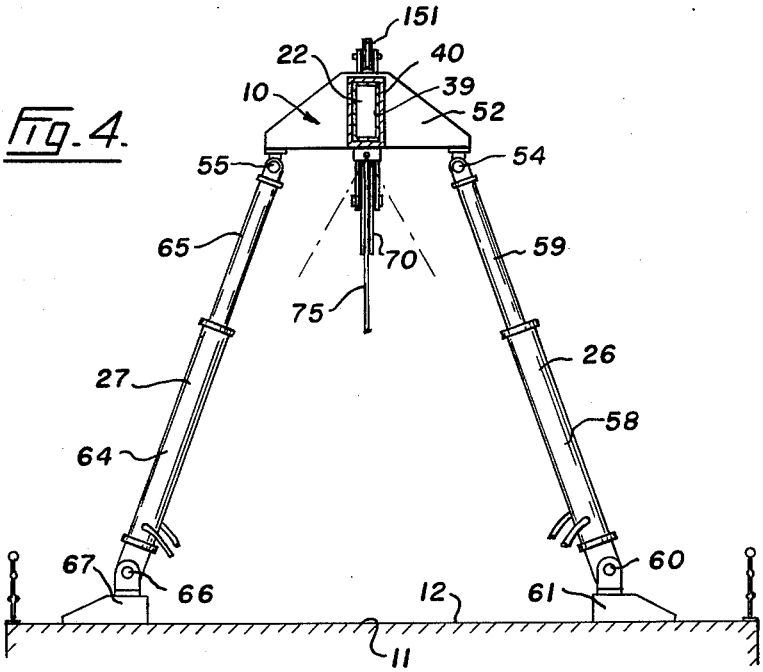
Figure 9:
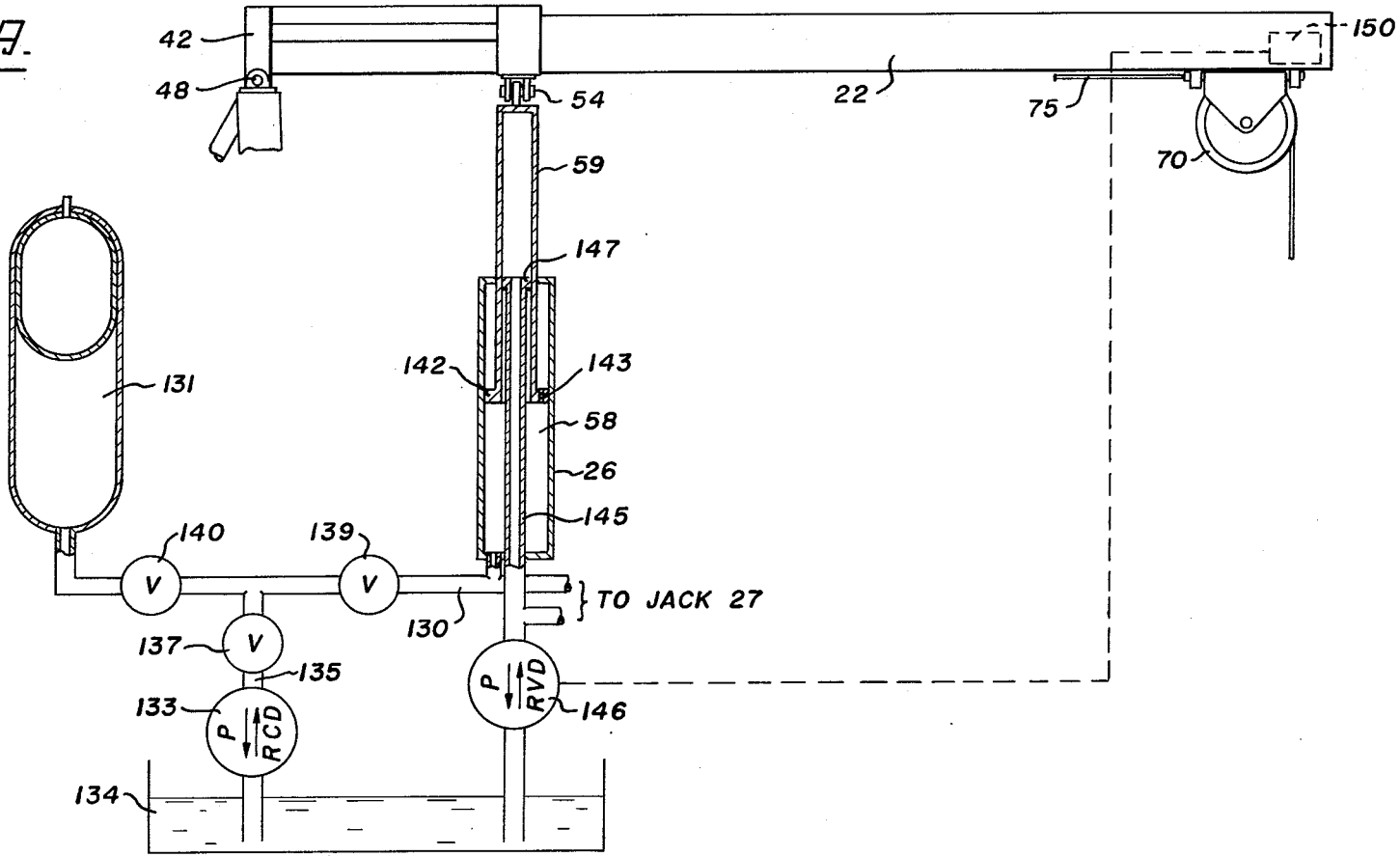

Examples of this invention are illustrated in the accompanying drawings in which, FIG. 1 is a side elevation of a heave compensating crane mounted on the deck of a ship at the stern thereof, FIG. 2 is a plan view of the crane, FIG. 3 is an elevation of the inboard end of the crane, FIG. 4 is a section taken on the line 4—4 of FIG. 2, FIG. 5 is an enlarged section taken on the line 5—5 of FIG. 2, FIG. 6 is a fragmentary side elevation of the portion of the boom shown in FIG. 5, FIG. 7 is an enlarged vertical section through an alternative form of boom having a carriage thereon, FIG. 8 is a fragmentary side elevation of a portion of the boom shown in FIG. 7, and FIG. 9 is a diagram of a hydraulic system of the illustrated crane.

Referring to FIGS. 1 to 6 of the drawings, 10 is a heave compensating crane in accordance with this invention mounted on the deck 11 of a ship 12 near the stern 13 thereof. Crane 10 consists of a base 18, a boom 22, and a pair of telescopic hydraulic jacks 26 and 27.

Base 18 can be of any suitable construction, and in this example, the base consists of a pad 30 firmly secured to deck 11, a pair of substantially vertical side support mebmers 31 and 32 secured to this pad and projecting upwardly therefrom, a pair of inclined braces 34 and 35 secured to the upper ends of side supports 31 and 32 and inclined downwardly and rearwardly therefrom to pad 30, to which the lower ends of these braces are secured.

Boom 22, in this example, consists of an outer section 39 telescopically mounted in an inner section 40. A transverse crosshead 42 is fixedly secured to the inner end of inner boom section 40 and extends outwardly over the upper ends of base supports 31 and 32. Lugs 44 and 45 project downwardly from the ends of this crosshead into sustantially bearing brackets 46 and 47, and pins 48 and 49 extend respectively through lug 44, bracket 46 and lug 45, bracket 47. This arrangement swingably mounts the inboard end of boom 22 on the base 18.

Another transverse crosshead 52 is fixedly secured to the outer end of inner boom section 40, and the outer ends of this crosshead are pivotally connected to the upper ends of jacks 26 and 27 by pins 54 and 55.

Jack 26 consists of a cylinder 58 and a ram 59, the outer end of this ram being connected to crosshead 52 by pin 54. The lower end of cylinder 58 is connected by a pin 60 to a bracket 61 fixedly mounted on deck 11. Similarly, jack 27 consists of a cylinder 64 and a ram 65, the upper end of which is connected by pin 55 to crosshead 52. The lower end of cylinder 64 is connected by a pin 66 to a bracket 67 fixedly mounted on deck 11. By referring to FIGS. 2 and 4, it will be seen that the upper ends of jacks 26 and 27 are connected to boom 22 through crossheads 52, and that these jacks are inclined downwardly and outwardly relative to the boom and lie in a plane which extends sustantially normal to the boom axis. These jacks support the outboard end of the boom since the latter is free to pivot about pins 48 and 49 which are on a common axis 68.

A sheave or pulley 70 is mounted on the outer section 39 of boom 22 near the outboard end thereof. This pulley is mounted for transverse swinging action on a hollow pin 71 carried by lugs 72 projecting downwardly from the boom, this pin extending longitudinally of said boom. A load cable 75 is threaded over pulley 70 and has a free end 76 to which a load may be connected. This cable extends over pulley 70 into pin 71 and along the lower surface of the boom to a traction winch generally designated by the numeral 79. This winch consists of upper and lower traction drums 81 and 82, and cable 75 extends over drum 81 and around this drum and drum 82 in a desired number of successive loops 84. After extending around these winch drums, the cable extends under a pulley 86 mounted on pad 30 and thence to a take-up drum 88 around which it is wound. This drum is rotated in any suitable manner, such as by an electric or hydraulic motor 89 which is drivingly connected to the drum through a chain and sprocket arrangement 90, see FIG. 1.

By referring to FIG. 3, it will be seen that upper winch drum 81 is mounted on a shaft 91 journalled in suitable bearings carried by side supports 31 and 32 of base 18, this shaft being near and just below the pivot pins 48, 49 (axis 68) of boom 22 so that its pitch circle coincides with axis 68. This shaft is rotated by the hydraulic or electric motor 94, see FIG. 2. Lower winch drum 82 is mounted on a shaft 96 journalled in suitable bearings carried by base supports 31 and 32, and a hydraulic or electric motor 97 is connected to said shaft, motors 94 and 97 being suitably mounted on base 18. The drive units 94 and 97 are reversible and are synchronized so that they can rotate winch drums 81 and 82 to pay out cable 75 or to reel in said cable. Motor 89 is simultaneously operated to rotate take-up drum 88 to feed cable to, or take up cable from winch 79.

Boom 22 is telescopic so that the outer section 39 thereof can be moved to shift pulley 70 outboard and inboard Boom section 39 can be moved back and forth in any suitable manner, and FIGS. 5 and 6 illustrate one way of accomplishing this. The inner portion of boom section 39 slidably fits in boom section 40, and rides on a plurality of pads 102 lying therebetween. A rack 104 is mounted on and extends along the lower surface of boom section 39 and meshes with a gear 105 which is freely mounted on the shaft 93 of upper winch drum 81 and is selectively connected to said shaft by means of a clutch 106. The pitch diameter of gear 105 is equal to the tread diameter of drum 81.

When it is desired to extend or retract boom 22, the power unit 94 is operated to turn gear 105 through clutch 106 in the appropriate direction. As the pitch diameter of gear 105 is the same as the tread diameter of drum 81, cable 75 is payed out or reeled in at the same rate as the boom is extended or retracted so that any load carried by the free end of the cable remains at the same level during this movement.

In the apparatus described so far, pulley 70 is shifted outwardly or inwardly relative to the ship by extending or retracting the boom. FIGS. 7 and 8 illustrate an alternative way of shifting an alternative sheave 70*a* in a crane 10*a*. In this example, boom 22*a* is not extensible, but pulley 70*a* is swingably mounted by a hollow pin 76*a* on a carriage 115 which has a plurality of wheels 116 riding on tracks 117 mounted on and extending along the lower edge of the boom. A nut 120 connected to carriage 115 is threaded on a long threaded shaft 121 rotatably mounted adjacent its opposite ends in suitable bearings 122 carried by boom 22*a*. The threaded shaft 121 is rotated by a suitable power unit, such as an electric motor or hydraulic motor 125 carried by the inner end of the boom. The speed of drive unit 125 and the pitch of the thread of shaft 121 are such that when the shaft is rotated, the carriage and pulley move along the boom at the same rate as the cable 75. Thus, pulley 70*a* can be moved back and forth along the boom through carriage 115 by the rotation of the threaded shaft 121 in the appropriate direction.

Boom 12 is supported above deck 11 by the supports 31, 32 and the hydraulic jacks 26, 27. It is desirable to mount crane 10 so that boom 22 extends substantially along the longitudinal centerline of the ship so that transverse roll of the ship does not materially raise or lower the boom. However, a passive control system is provided for maintaining the outer end of the boom and, consequently, a load attached to cable 75 substantially in a desired attitude, which is preferably a horizontal position, regardless of movement of the ship under wave action, and FIG. 9 diagrammatically illustrates a hydraulic system associated with jacks 26 and 27 for this purpose. Jack 26 only is shown in this Figure, but it is to be understood that jack 27 is in parallel with it in the hydraulic system.

Cylinder 58 of jack 26 is connected by a pipe 130 to a gas bladder accumulator 131. A reversible pump 133 is adapted to draw oil from a reservoir 134 and to direct it to pipe 130 through another pipe 135. A valve 137 in pipe 135 is located between the pump and pipe 130, while valves 130 and 140 are located in pipe 130 respectively between pipe 135 and cylinder 58 and pipe 135 and accumulator 131. In this example, one accumulator 131 only is provided for both of the jacks 26 and 27, but it is to be understood that there could be a multiple accumulators for each jack. Ram 59 has a piston 142 on its inner end slidably mounted in cylinder 58, and said piston has an orifice 143 therein which acts as a restricted by-pass for oil to flow through as the piston moves up and down in the cylinder. The hydraulic system described so far is a passive control system which, by substantially setting the precharge pressure in accumulator 131, is sufficient if the crane is to be operated where comparatively mild conditions exist so that it is not subjected to relatively rapid changes in vertical forces.

If desired or necessary, an active hydraulic control system can be provided in addition to the passive system and in parallel therewith. In this example, an active control system is provided by making ram 59 hollow, and by providing a pipe 145 which extends from a variable displacement bidirectional pump 146 up through the center of cylinder 58 and opens out through a piston 147 which is connected to said pipe and slidably fits within the hollow ram. Piston 147 isolates the interior of ram 59 above the piston from the interior of cylinder 58. Pump 146 is also connected to a similar pipe within jack 27. Pump 146 draws oil from reservoir 134. A suitable detector, such as a vertically oriented accelerometer 150, is mounted on boom 22 near the outboard end thereof. This accelerometer is operatively connected through suitable elecronic circuitry to pump 146 so as to cause said pump to pump oil into ram 59 to offset any tendency of the outer end of the boom to move downwardly and to remove oil from said ram to offset any tendency of the outer end of the boom to move upwardly when the ship pitches and heaves under the action of the waves. As this accelerometer and the controls for the variable displacement pump are well known, they do not require detailed description herein.

The action of crane 10 is relatively simple. The passive control system is designed to retain the outer end of the boom and the load atached to cable 75 in a desired position, while the stern of the vessel rises and falls with the waves. If the stern of the vessel rises, the rams of the jacks move oil into the accumulator against the gas pressure thereof, thus tending to maintain the outer end of the boom in its the desired position. On the other hand, if the stern of the vessel falls, the gas pressure in the accumulator directs oil into the jack cylinders to maintain the outer end of the boom substantially in the desired position. The boom can be locked in position relative to the deck of the ship by closing either or both of the valves 139 and 140. The passive control system must be balanced to the load being carried by the lifting cable, and this is accomplished by injecting oil into or removing oil from the hydraulic system by pump 133. As stated above, this passive system may be used alone under some conditions.

When the active control system is used, the accelerometer 150 detects acceleration of the boom tip upwardly or downwardly, and it sends operation signals to pump 146 to offset or reduce this acceleration. If the stern of the vessel is rising and the boom tip tends to move with it, the accelerator signals pump 146 to withdraw oil from the rams of the jacks, whereas if the deck falls and the boom tip tends to move with it, pump 146 is operated to pump oil into the rams in order to offset or reduce the boom tip acceleration.

One or more auxiliary load cables can be mounted in crane 10. In this example, a cable 150 is threaded over a pulley 151 mounted on top of boom 22 at its outer end, and extends back to a powered winch drum 152 mounted on the boom at the inner end thereof.

The illustrated traction winch 79 and take-up drum or drums 88 make it possible to operate with very great lengths of cable, such as something of the order of 20,000 feet. However, if relatively short lengths of cable are used, a simple drum-type winch can be used. It will be noted that the compressive loads in the traction winch are balanced by the upward load exerted by the boom since both of these loads are created mainly by the weight or load on the free end of the cable and by the weight of the cable itself. Inversely, the loaded cable balances the boom on the support cylinders 26 and 27.

A control console, not shown, may be placed above the boom pivot for optimal control and visability, and the required prime mover unit, if hydraulic motors are used, can be located between the traction winch and the support jacks where it is out of the way and yet does not use up usable deck space around the crane. When not in use, the boom support cylinders can be fully retracted and hydraulically locked resulting in an effective A-frame support for the boom.

The center lines of the support cylinders 26 and 27 make an increasing compound angle with respect to the mean line of action of the boom during its downward deflection. This softens the effective spring co-efficient of the system for given accumlator volumes and precharges.

I claim:

1. A heave compensating crane to be mounted on a ship and adapted to support loads over the side of the ship at constant depths in the water unaffected by motions of the ship resulting from wave action, said crane comprising a base to be mounted on a ship, a boom mounted adjacent an inner end thereof on a pivot carried by the base for swinging movement in a substantially vertical plane and having an outer end adapted to extend towards the side of the ship, said boom comprising inner and outer telescopic sections, telescopic hydraulic jack means to be mounted on the ship and connected to the boom spaced from the pivot thereof to support the boom, a pulley mounted on the outer section of the boom and positioned at the side of the ship when the crane is in operation, a cable threaded over the pulley and having a free end to which a load can be attached, said cable extending from the pulley towards the inner end of the boom, winch means for reeling in and paying out the cable, means for shifting said outer section inwardly and outwardly relative to the inner section of the boom to shift the pulley towards and away from the base, and a passive control system comprising accumulator means connected to the jack means for retaining the boom through said jack means in position maintaining the load attached to and supported by the cable substantially unaffected by ship motion resulting from wave action.

2. A crane as claimed in claim 1 including means for moving the cable in or out as the pulley moves inwardly or outwardly respectively in accordance with said movement to prevent the load carried by the cable from falling or rising during said movement of the pulley.

3. A crane as claimed in claim 1 in which said hydraulic jack means comprises two telescoping hydraulic jacks each having one end connected to the boom and an opposite end to be connected to said ship, said jacks being inclined laterally and downwardly from the boom and away from each other.

4. A crane as claimed in claim 1 in which said hydraulic jack means comprises two hydraulic jacks, each jack including two telescopic sections with the outer end of one of said sections connected to the boom and the outer end of the other of said sections connected to said ship, said jacks being inclined laterally and downwardly from the boom and away from each other.

5. A crane as claimed in claim 4 including means for selectively supplying hydraulic fluid to and removing said fluid from the sections of the jacks which are connected to the support.

6. A heave compensating crane to be mounted on a ship and adapted to support loads over the side of the ship at constant depths in the water unaffected by motions of the ship resulting from wave action, said crane comprising a base to be mounted on a ship, a boom mounted adjacent an inner end thereof on a pivot carried by the base for swinging movement in a substantially vertical plane and having an outer end adapted to extend towards the side of the ships, a carriage mounted on the boom for movement longitudinally of the boom to and from near the outer end thereof, a pulley carried by the carriage, means connected to the carriage for moving the latter and the pulley inwardly and outwardly relative to the boom, a cable threaded over the pulley and having a free end to which a load can be attached, said cable extending from the pulley towards the inner end of the boom, winch means for reeling in and paying out the cable, means for moving the cable in or out as the carriage moves inwardly or outwardly respectively in accordance with said movement to prevent the load carried by the cable from falling or rising during said movement of the carriage, and a passive control system comprising accumulator means connected to the jack means for retaining the boom through said jack means in position maintaining the load attached to and supported by the cable substantially unaffected by ship motion resulting from wave action.

7. A crane as claimed in claim 6 in which said hydraulic jack means comprises two telescoping hydraulic jacks each having one end connected to the boom and an opposite end to be connected to said ship, said jacks being inclined laterally and downwardly from the boom and away from each other.

8. A crane as claimed in claim 7 in which said accumulator means comprises a gas bladder accumulator connected to the hydraulic jacks to receive hydraulic fluid therefrom.

9. A crane as claimed in claim 8 including means for selectively supplying hydraulic fluid to and removing said fluid from the jacks and said accumulator to adjust to the load to be carried by the cable.

10. A crane as claimed in claim 6 in which said winch means comprises an upper drum and a downwardly-spaced lower drum mounted on the support, said cable being wound around both drums in successive loops, the axis of the upper drum being parallel with the axis of the pivot of the boom, said upper drum being located adjacent said pivot with the pitch circle of the upper drum coinciding with the axis of the pivot, reversible power means connected to the drums to move the cable therearound to raise and lower the free end of the cable, and drum means for reeling in the cable from and paying out the cable to said pair of drums.

11. A heave compensating crane to be mounted on a ship and adapted to support loads over the side of the ship at constant depths in the water unaffected by motions of the ship resulting from wave action, said crane comprising a base to be mounted on a ship, a boom mounted adjacent an inner end thereof on a pivot carried by the base for swinging movement in a substantially vertical plane and having an outer end adapted extend towards the side of the ship, telescopic hydraulic jack means to be mounted on the ship and connected to to boom spaced from the pivot thereof to support the boom in a normal position relative to the ship, a pulley carried by the boom positioned at the side of the ship when the crane is in operation, a cable thread over the pulley and having a free end to which a load can be attached, said cable extending from the pulley towards the inner end of the boom, winch means for reeling in and paying out the cable; a passive control system comprising accumulator means connected to the jack means for retaining the boom through said jack means in position maintaining the load attached to and supported by the cable substantially unaffected by ship motion resulting from wave action; and an active control system parallel to said passive system and connected to the jack means, said active system comprising means on the boom near the outer end thereof for detecting movement of the boom outer end downwardly or upwardly, and pump means responsive to said detecting means for directing hydraulic fluid to extend or retract the jack means to offset the tendency of the outer end of the boom and consequently a load attached to the cable to move respectively downwardly or upwardly.

12. A crane as claimed in claim 11 in which said winch means comprises a pair of spaced-apart winch drums mounted on said support, said cable being wound around both drums in successive loops, and reversible power means connected to the drums to move the cable therearound to raise and lower the free end of the cable.

13. A crane as claimed in claim 11 in which said winch means comprises a pair of spaced-apart winch drums mounted on said support, said cable being wound around both drums in successive loops, reversible power means connected to the drums to move the cable therearound to raise and lower the free end of the cable, and drum means for reeling in the cable from and paying out the cable to said pair of drums.

14. A crane as claimed in claim 11 in which said winch means comprises a pair of spaced-apart winch drums mounted on said support, said cable being wound around both drums in successive loops, one of said winch drums being located adjacent the pivot of the boom and the other of said winch drums being located below said one drum, reversible power means connected to the drums to move the cable therearound to raise and lower the free end of the cable, and drum means for reeling in the cable from and paying out the cable to said pair of drums.

15. A crane as claimed in claim 11 in which said hydraulic jack means comprises two hydraulic jacks, each jack including two telescopic sections with the outer end of one of said sections connected to the boom and the outer end of the other of said sections connected to said ship, said jacks being inclined laterally and downwardly from the boom and away from each other.

16. A crane as claimed in claim 15 including means for selectively supplying hydraulic fluid to and removing said fluid from the sections of the jacks which are connected to the support.

17. A crane as claimed in claim 16 in which the jack sections connected to the boom are hollow with the interiors thereof isolated from the interiors of the respective remaining sections of the jacks, and said pump means directs the hydraulic fluid into and removes said fluid from the hollow jack sections.

18. A crane as claimed in claim 11 including means for shifting the pulley towards and away from said base.

19. A crane as claimed in claim 11 in which said winch means comprises an upper drum and a downwardly-spaced lower drum mounted on the support, said cable being wound around both drums in successive loops, the axis of the upper drum being parallel with the axis of the pivot of the boom, said upper drum being located adjacent said pivot with the pitch circle of the upper drum coinciding with the axis of the pivot, reversible power means connected to the drums to move the cable therearound to raise and lower the free end of the cable, and drum means for reeling in the cable from and paying out the cable to said pair of drums.

20. A heave compensating crane to be mounted on a ship and adapted to support loads over the side of the ship at constant depths in the water unaffected by motions of the ship resulting from wave action, said crane comprising a base to be mounted on a ship, a boom mounted adjacent an inner end thereof on a pivot carried by the base for swinging movement in a substantially vertical plane and having an outer end adapted to extend towards the side of the ship, two hydraulic jacks, each jack including two telescopic sections with the outer end of one of said sections connected to the boom and the outer end of the other of said sections connected to said ship, said jacks being inclined laterally and downwardly from the boom and away from each other, a pulley carried by the boom and positioned at the side of the ship when the crane is in operation, a cable threaded over the pulley and having a free end to which a load can be attached, said cable extending from the pulley towards the inner end of the boom, winch means for reeling in and paying out the cable; a passive control system comprising gas accumulator means connected to the jacks for retaining the boom through said jacks in position maintaining the load attached to and supported by the cable substantially unaffected by ship motion resulting from wave action; and an active control system parallel to said passive system and connected to the jacks, said active system comprising means on the boom near the outer end thereof for detecting movement of the boom downwardly or upwardly, the jacks sections which are connected to the boom being hollow with the interiors thereof isolated from the interior of the respective remaining sections of the jacks, and pump means responsive to said detecting means for directing hydraulic fluid into and removing said fluid from the hollow jack sections to compensate the tendency of the boom and consequently a load attached to the cable to move respectively downwardly or upwardly.

* * * * *